US008832880B2

(12) United States Patent
Sheard

(10) Patent No.: US 8,832,880 B2
(45) Date of Patent: Sep. 16, 2014

(54) I SEE YOU BABY BLANKET

(76) Inventor: Daniel Christopher Sheard, Middletown, NJ (US)

( * ) Notice: Subject to any disclaimer, the term of this patent is extended or adjusted under 35 U.S.C. 154(b) by 0 days.

(21) Appl. No.: 13/542,498

(22) Filed: Jul. 5, 2012

(65) Prior Publication Data

US 2014/0007352 A1 Jan. 9, 2014

(51) Int. Cl.

| | |
|---|---|
| ***A47C 20/02*** | (2006.01) |
| ***A47G 9/06*** | (2006.01) |
| ***A47D 13/00*** | (2006.01) |
| *A47D 15/00* | (2006.01) |

(52) U.S. Cl.

CPC ..... *A47D 13/00* (2013.01); *A47G 9/066* (2013.01); *A47D 15/008* (2013.01)

USPC ..... 5/655; 5/485; 5/413 R; 2/69; 2/69.5

(58) Field of Classification Search

USPC ..... 5/713, 655, 485, 494, 495, 413 R; 2/69, 2/69.5

See application file for complete search history.

(56) References Cited

U.S. PATENT DOCUMENTS

| | | | | |
|---|---|---|---|---|
| 2009/0199343 | A1* | 8/2009 | Collins | 5/655 |
| 2011/0154573 | A1* | 6/2011 | Hinderliter, II | 5/655 |
| 2013/0091633 | A1* | 4/2013 | Garofalo | 5/655 |
| 2013/0097783 | A1* | 4/2013 | Hinderliter, II | 5/655 |

OTHER PUBLICATIONS

Stages of infant development, as illustrated by responses to the peekaboo game, By Patrice Marie Miller and Michael Lamport Commons, Behavioral Development Bulletin, Spring 2007.

Early cortical specialization for face-to-face communiction in human infants, Proceedings of the Royal Society B: Biological Sciences Dec. 22, 2008 vol. 275 No. 1653 2803-2811.

Peekaboo A New Look at Infants' Perception of Emotional Expressions By; Diane P. F. Montague and Arlene S. Walker-Andrews Developmental Psychology Nov. 2001 vol. 37, No. 6, 826-838.

* cited by examiner

*Primary Examiner* — Brittany Wilson

(74) *Attorney, Agent, or Firm* — Robert J. Ferb

(57) ABSTRACT

An improved baby blanket designed to enhance interactions between infants and caregivers to improve social development, reaching developmental milestones, provide a soothing environment, mitigate Colic and reduce gastric reflux by placing an infant facing the caregiver between the caregiver's upper legs with knees bent and the caregiver in a seated position on a flat surface. This improved baby blanket is comprised of a generally rectangular shaped fabric blanket which is of sufficient length to cover a caregiver's legs and torso, which is further comprised of foot warmer pockets, side panels with reinforced stitching attaching said side panels to said blanket and a removable swaddle attachment, said swaddle attachment being further comprised of a generally rectangular fabric swaddle blanket comprised of side flaps and a bottom flap which are folded and removably attached to each other by attachment means to wrap an infant in said swaddle blanket which swaddle blanket is removably attached to said baby blanket.

19 Claims, 14 Drawing Sheets

I SEE YOU BABY BLANKET

FIELD OF THE INVENTION

This invention relates generally to devices and methods to increase interactions between infants and their parents or other caregivers to enhance the infant's social development, reaching developmental milestones and providing comfort and a soothing environment to mitigate the effects of conditions such as Colic and facilitating positioning of an infant to reduce the occurrence of gastric reflux after feeding.

BACKGROUND OF INVENTION

Infants have been cared for and protected in innumerable ways over the millennia. Many methods, such as swaddling, where bands of cloth are used to wrap infants, or various slings, carriers or other devices are also used to protect infants from the elements, maintain closeness with their mother, permit their mother to work or travel with her hands free are among the many functions of these devices. While there are many benefits from using these devices they also have some disadvantages. For example the centuries old art of swaddling, which entails laying an infant onto a blanket fabricated from soft material and wrapping the infant therein by means of a series of blanket folds, wraps and tucks, has proven to be less desired in that it presents a somewhat bulky package and fails to provide adequate head and neck support for the infant. Furthermore, the infant is often able to kick out of a traditional swaddle. The other devices, while they also have substantial utility, do not focus on certain aspects of parent-child interactions that have been found to have significant benefits to the development of children.

Research into the effects of interactions between infants and their caregivers has demonstrated that certain forms of interaction, including play, provides an environment that has significant benefits to facilitate social, language, and large and small motor development. (www.americanpregnancy-.org/firstyearoflife/firstyeardevelopment.html) These skills are achieved normally by infants in their first year and are followed by observing the infant's achieving various developmental milestones. (www.americanpregnancy.org/firstyearoflife/firstyeardevelopment.html and www.babycenter-com/0_milestone-chart-1-to-6-months__1496585.bc) The development of these skills are observed and monitored by caregivers to see if development is occurring in the usual time frame. Substantial benefits have been attributed to increased interaction between infants and their caregivers, including achievement of these developmental milestones, long term benefits involving development of social skills and the benefit of close observation in early detection of hearing or vision problems or problems with large motor development. (www.parentsconnect.com/parenting-your-kids/baby/health/determining_baby_vision_concern.html Dr. Richard W. Hertle)

Many of the interactions between an infant and a caregiver are most beneficial if they face each other and can see each others face. (Stages of infant development, as illustrated by responses to the peek-aboo game, By Patrice Marie Miller and Michael Lamport Commons, Behavioral Development Bulletin, Spring 2007, Early cortical specialization for face-to-face communication in human infants, Proceedings of the Royal Society B: Biological Sciences 22 Dec. 2008 vol. 275 no. 1653 2803-2811, and Peekaboo A New Look at Infants' Perception of Emotional Expressions By; Diane P. F. Montague and Arlene S. Walker-Andrews, Developmental Psychology November 2001 Vol. 37, No. 6, 826-838). While many of the slings or other devices hold an infant close to the caregiver most do not facilitate face to face eye contact because of their configuration. There are also devices that can be used to hold an infant such as swings, strollers, care seats or other devices to support and constrain an infant but all of these devices interpose a physical separation between the infant and the caregiver.

SUMMARY OF THE INVENTION

The present invention, the I See You Baby Blanket™, is an improved device in the form of a blanket, to enhance and help monitor social, language and large and small motor development milestones, provide face to face hands free interaction, warmth, comfort, head and neck support, help mitigating Colic by facilitating a rocking motion and reducing the occurrence of gastric reflux by maintaining the infant in an inclined position after feeding.

One of the more frequent problems with infants is Colic. This condition is often addressed by comforting the infant and by engaging is some form of movement. The present invention addresses both of these approaches by placing the infant in the swaddle attachment and the caregiver rocking his or her knees side to side to gently sway the infant. (http://similac-.com/feeding-nutrition/crying-and-colic?utm_source=google&utm_medium=ppc&utm_term=colic%20baby&utm_campaign=Feeding%20Expert%20Category&cid=ppc_an_sim_ggl_feed__0473)

An additional common occurrence with infants is gastric reflux which is often observed when an infant spits up what he or she has just eaten. One way to address this is to maintain the infant in an inclined position between 30 and 45 degrees from vertical and avoid laying the infant down flat for approximately thirty minutes after the infant is fed. (The Cause and Treatment of Infant Reflux By: J. J. Courtiol, M. A. Ed., http://www.coliccalm.com/baby_infant_newborn_articles/acid-reflux.htm and http://www.livingwithreflux.org/medications_for_reflux.html)

It is well known that development of infants is achieved through interactions with their parents and caregivers. Some of the first milestones are related to vision and social development. The unique design of the I See You Baby Blanket™ allows the infant to be safely and securely placed in between the parents or caregiver legs in such a manner that their head and neck are supported and the infant is positioned in such a way to achieve nearly constant eye contact, as well as facilitate entertainment, massages, and verbal interaction along with the ability to play social development games such as Peek-A-Boo. The design allows parents and caregivers to have their hands free at all times and ensure that the infant is securely positioned in between the knees of the parent or caregiver using a removable swaddle attachment which is attached by Velcro pads to the blanket. The removable swaddle attachment is designed to allow easy access to the infant's feet and stomach for massages to relieve the discomfort of Colic. The I See You Baby Blanket™ provides comfort, warmth and support to both the infant and the parent or caregiver. The I See You Baby Blanket™ has a foot warmer compartment with a seam in the center creating individual compartments for each foot, and reinforced seams along the sides and across the top of the knees to provide the parent or caregiver additional lateral support to hold the infant and the caregiver's knees in the upright position with little or no muscle effort to allow for long periods of use and permit the caregiver to rock the infant from side to side with little stress or fatigue during the period of Colic crying episodes. The design of The I See You Baby Blanket™ permits the caregiver to maintain the infant in an inclined position between 30 and 45 degrees from vertical to reduce the occurrence of gastric reflux. The width and length of The I See You Baby Blanket™ provides maximum coverage for both the infant and parent or caregiver. The length of The I See You Baby Blanket™ allows the parent or caregiver to cover the infant and or play social development games such as Peek-A-Boo with the infant.

The I See You Baby Blanket™ is fabricated from a soft material. The blanket allows a parent or caregiver to position the infant in between their knees and swaddle or cuddle an infant in a uniquely supportive manner. This enhances the parent or caregiver's ability to rock, comfort and interact hands free with the infant and maintain eye contact to enhance the infant's Milestone achievement, Social development and reduce the symptoms of Colic and acid reflux. The I See You Baby Blanket™ is designed to be used when the parent or caregiver is in a seated or reclined position on a chair or sofa or on the floor or other flat surface. The parent or caregiver inserts his or her feet into the "Foot Warmer Compartment" and drapes the blanket over his or her legs and knees and covers his or her torso. The I See You Baby Blanket™ has reinforced seams on the sides and at the mid-point across the top of the knees. The reinforced seams on the sides, foot warmer section and across the mid-point of the knees provide lateral support for the knees so the parent or caregiver does not have to use their muscles to hold the legs and knees in an upright position, thus allowing them to maintain eye contact, rock, entertain, comfort and massage the infant with hands free for longer periods of time with little or no fatigue. To facilitate use of the I See You baby Blanket™ with the removable swaddle attachment removed, in the middle part of the I See You Baby Blanket™ in the section between the knees, from the top of the knees to the parent or caregivers waist, a flap of fabric covers the Velcro attachment for the removable swaddle attachment. The removable swaddle attachment is designed to securely and comfortably swaddle the infant while preventing the infant from kicking out of the swaddle.

The I See You Baby Blanket™ provides for hands free interaction with an infant by a parent or caregiver that allows the parent or caregiver to maintain eye contact, provide body and foot massage which enhances milestone development both visual and social and rocking and massage to relieve the symptoms of Colic.

The I See you Baby Blanket™ and swaddle attachment is preferably produced in cotton, fleece, or cashmere or other natural or synthetic materials to be soft, warm and produce a soothing environment for the infant.

The I See You Baby Blanket™ has reinforced seams at the left and right side extensions and laterally across the top in between the knees for strength and support for rocking and to maintain the proper angle for the tension to provide the correct support of the infants head and neck. The proper tension is necessary to relieve the exertion of the muscles and maintain the proper distance from the parent or caregiver eyes and hands free interaction.

The I See You Baby Blanket™ has a cover to maintain the integrity of the Velcro that secures the removable swaddle blanket and also protects an infant from direct contact with the Velcro surface. The cover can be embroidered for personalization.

The removable swaddle attachment is designed to comfortably and securely swaddle the infant so that the parent or caregiver can rock, entertain, massage the feet and stomach and be removed for cleaning The removable swaddle attachment is a rectangle made of the same or similar material as the I See You Baby Blanket™ and the left panel has Velcro to secure the bottom flap and the right panel has Velcro to secure both the left panel and bottom flap.

The back of the removable swaddle attachment has Velcro to secure it to the body of the I See You Baby Blanket™. The bottom flap of the removable swaddle attachment can be adjusted to allow full access to the feet of the infant for massages to relieve/reduce the discomfort of Colic.

The preferred embodiment of the I See You Baby Blanket™ has the additional length to provide for complete coverage of the torso for warmth of the parent or caregiver. The additional length also allows the parent or caregiver to play social development games such as Peek-A-Boo by permitting the parent or caregiver to hide behind the portion covering the torso and peek out at the infant.

In the preferred embodiment of the I See You Baby Blanket, the overall length is approximately 72 to 76 inches to completely cover a caregiver's legs and torso, 29 to 31 inches in width including the 6 inch side panels, has a 12 inch deep foot warmer and a removable swaddle attachment approximately 23 to 25 inches long, 24 to 36 inches wide with an extended bottom flap approximately 10 to 12 inches wide and 10 to 12 inches long which can be folded over the infant's feet. Other variations on the overall length, to accommodate different sized parents or caregivers or for different configurations such as a variation that does not cover a caregiver's torso which would be in the range of 52 to 56 inches in length, but which could be shorter or longer to accommodate different sized caregivers or a variation that only covers a caregivers knees and upper legs or a caregivers knees, upper legs and torso. Wider and narrower configurations are also contemplated to accommodate different sized caregivers.

The foot warmer is sized to receive the feet of the parent or caregiver and adjust the tension of the blanket to support the infant's head and neck in the removable swaddle attachment. The foot warmer also plays a primary role in adjusting the distance of the infants head to the parents or caregivers head and eyes. The foot warmer has sewn seams along the sides and in the center of the warmer to maintain the size and integrity of the foot warmer section. The I See You Baby Blanket™ in the preferred embodiment has a removable attachment cover sized to protect the Velcro attachment and maintain the integrity of the Velcro and comfort of the infant if the removable swaddle attachment is not in use. The swaddle attachment cover can be embroidered or decorated in other ways for personalization. The removable swaddle attachment is sized to comfortably and warmly securely hold an infant. The Removable swaddle attachment is a rectangle made of cotton or other suitable material to ensure breath ability. The right side panel of the attachment is wrapped over the infant then the left side panel is wrapped over the infant and secured with Velcro. The bottom flap of the swaddle attachment is them pulled over the infant's feet and secured with Velcro. If the parent or caregiver wants to massage the infants feet the bottom flap is easily pulled down to gain access. The back of the removable swaddle attachment has Velcro to secure it to the body of the I See You Baby Blanket™. More than one attachment point using Velcro or other means of attachment between the removable swaddle attachment and the I See You Baby Blanket™ are also contemplated. The bottom flap of the removable swaddle attachment can be adjusted to allow full access to the feet of the infant for massages to relieve/reduce the discomfort of Colic. The side panels on the left and right sides of the I See You Baby Blanket™ are sized to ensure the parent or caregiver is completely covered to ensure comfort and warmth. The side panels have reinforced seams to provide additional support to the knees for extended use to reduce the use of the muscles to maintain the desired knee angle and allow for rocking the infant. The knee angle is critical to maintain the proper distance between the infants and parents or caregivers eyes for the best visual image and interaction. Horizontal knee support seams are reinforced and positioned at the location of the parent or caregiver's knees to maintain the proper knee angle and reduced exertion and stress of the muscles of the parent or caregiver. The I See You Baby Blanket™ permits a caregiver or parent to adjust the position of their knees both as to the separation between the knees and to the angle between the individual's upper and lower legs to place an infant in an optimum position for the purposes set forth herein while accommodation the position of the parent or caregiver, whether seated on the floor or other flat surface or sitting on a chair, cushion or in a reclining position.

It is an object of the present invention to provide an improved device in the form of a blanket that facilitates face to face eye contact between an infant and a caregiver.

It is also an object of the present invention to provide a device to permit a caregiver to have long periods of interaction with an infant to promote and monitor the specific behavior of an infant for the purpose of observing developmental milestones and the infant's responses to auditory and visual stimuli.

It is a further object of the present invention to provide a device to position an infant to minimize the occurrence of gastric reflux.

It is an additional object of the present invention to provide a caregiver a means to comfort and rock an infant during bouts of Colic.

It is also an object of the present invention to facilitate playing Peek A Boo games with an infant to enhance social development.

It is also an object of the present invention to provide a device to permit a caregiver and infant to maintain close proximity while both are able to nap

DETAILED DESCRIPTION OF THE INVENTION

Figure 1:
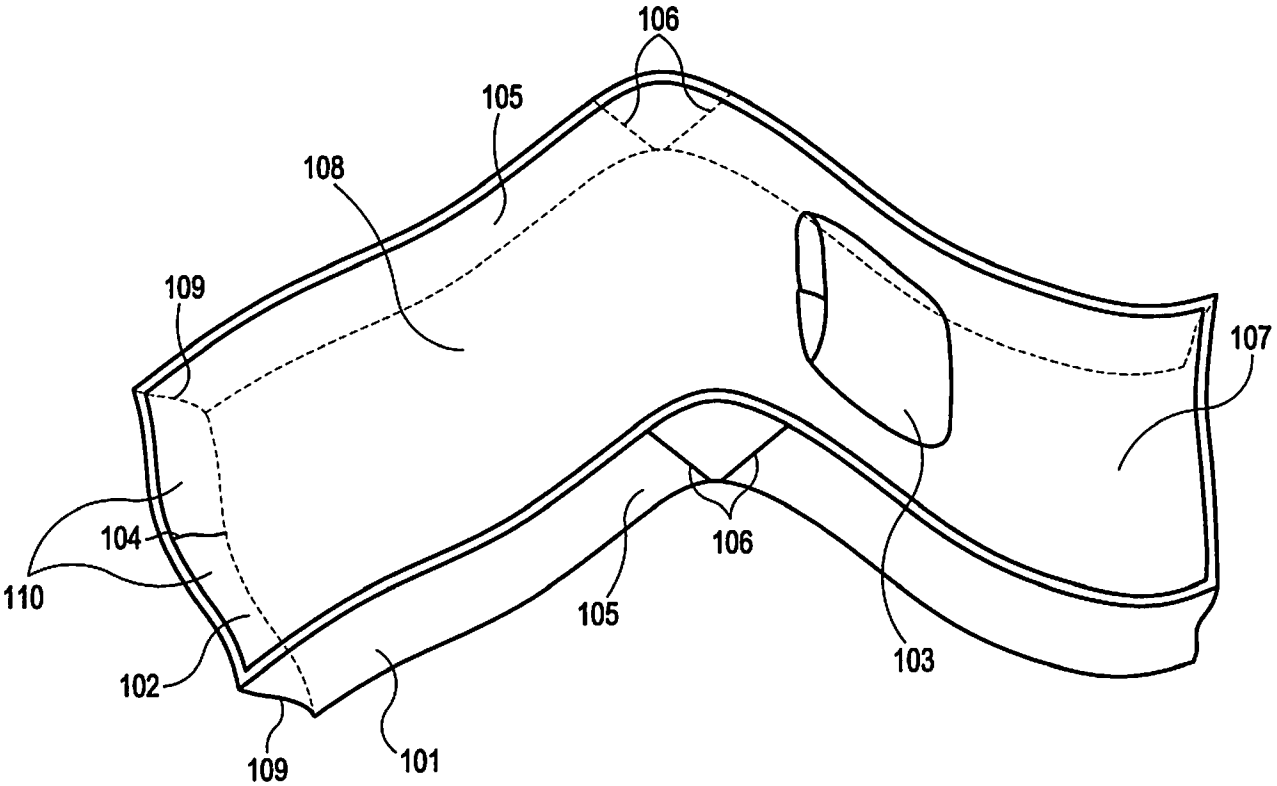
FIG. 1. Is a perspective view of the preferred embodiment of present invention.

The preferred embodiment of the present invention is shown in FIG. 1. I See You Baby Blanket 101 includes foot warmer section 102, lower leg cover 108, upper leg and body cover 107, side panels 105, with reinforced seams 106, and swaddle attachment 103. Reinforced seams 106 provide support for a caregiver's knees when using I See You Baby Blanket 101. Foot warmer 102 is sized to receive the feet of the parent or caregiver and to adjust the tension of the blanket to support an infant's head and neck when placed in removable swaddle 103. Foot warmer 102 also plays a primary role in adjusting the distance of the infant's head to the parent or caregiver's head and eyes. Foot warmer 102 has sown seams 109 which connect side panels 105 to foot warmer 102. Seam 104 connects the center of foot warmer 102 to lower leg cover 108 to form foot pockets 110 to maintain the size and integrity of foot warmer 102. Foot pockets 110 are approximately 12 inches deep in the preferred embodiment and the caregiver inserts his or her feet into said into said foot pockets 110. Said foot pockets 110 may be deeper or shallower to suit different sized feet to provide greater or lesser coverage of a caregiver's feet. However, embodiments without said seam 104 are also contemplated.

Figure 2:
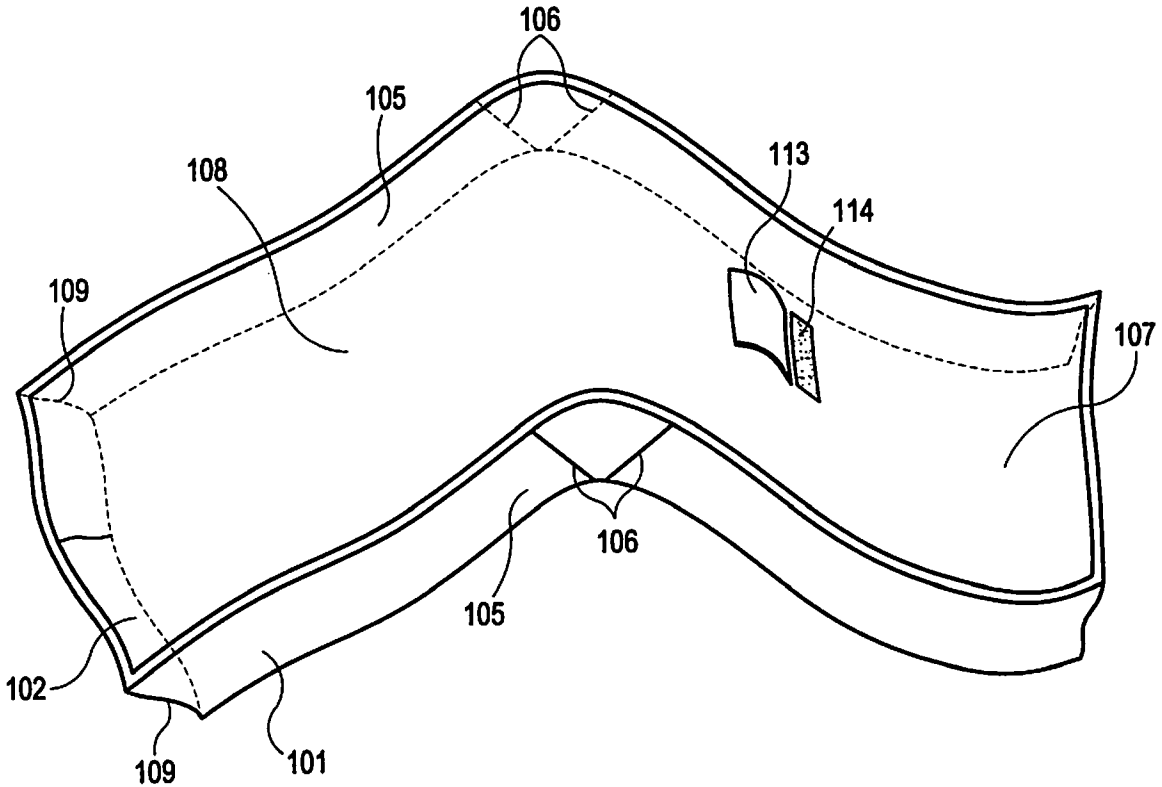
FIG. 2. is a perspective view of the present invention without the swaddle attachment in place.
Figure 3B:
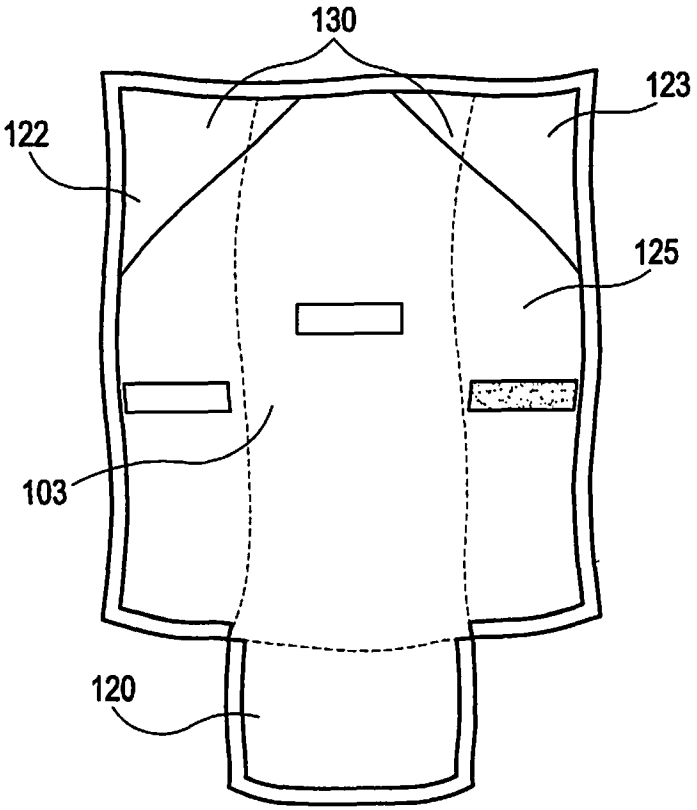
FIG. 3B. is a back view of the swaddle attachment
Figure 3A:
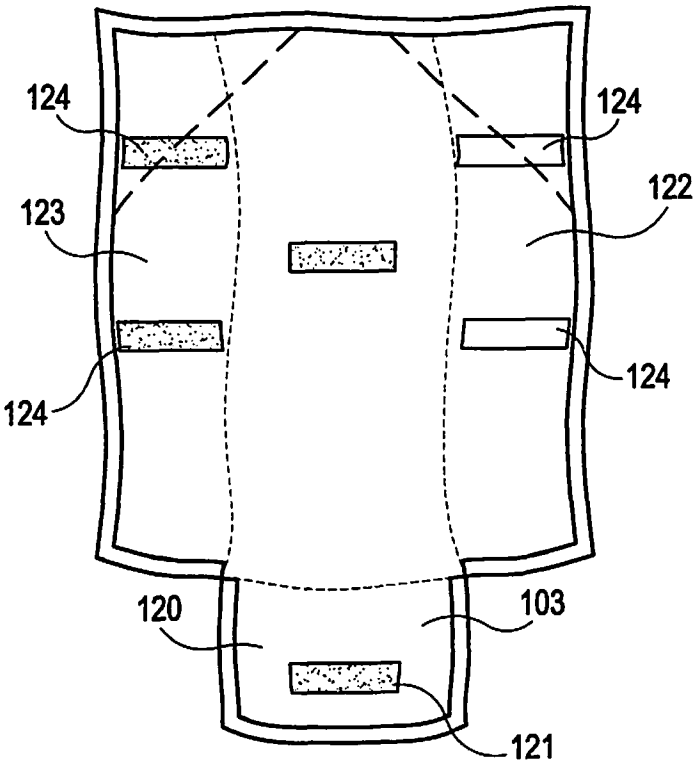
FIG. 3A. is a front view of the swaddle attachment.
Figure 4:
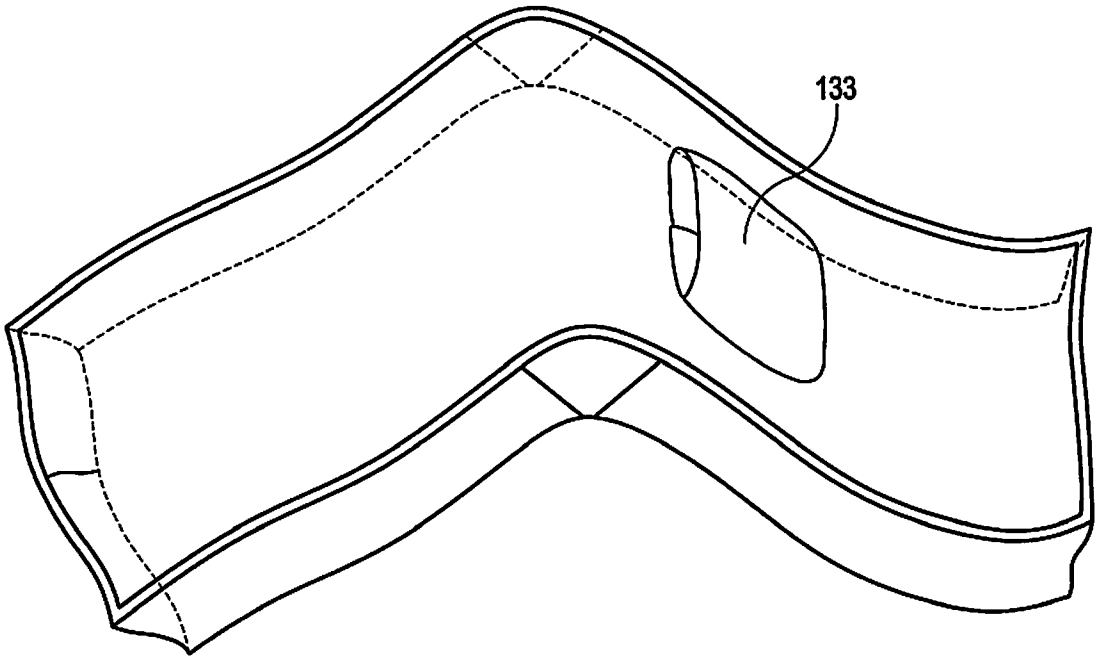
FIG. 4 is a perspective view of an embodiment with a non-removable swaddle pocket

Swaddle attachment 103 as shown in FIG. 2 illustrates I See You Baby Blanket 101 with swaddle attachment 103 removed showing Velcro attachment 114 and removable Velcro attachment cover 113 with Velcro attachment cover 113 in place covering Velcro attachment 114. This provides for protection of Velcro attachment 114 and provides for comfort of an infant placed on I See You Baby Blanket 101 when swaddle attachment 103 is not in use. Swaddle attachment 103 can be embroidered or customized for personalization as shown in FIG. 3B by adding such embroidery or other decorations to decorative surfaces 130. Removable swaddle attachment 103 is sized to comfortably, warmly and securely hold an infant. Removable swaddle attachment 103 as shown in FIGS. 3A and 3B is sized to comfortably, warmly and securely hold an infant. Removable swaddle blanket 103 is rectangular in shape as shown in FIGS. 3A and 3B and in the preferred embodiment is made of a breathable material such as cotton or other material similar to or identical to that used for I See You Baby Blanket 101. Removable swaddle attachment 103 is used by placing the infant in the center of said removable swaddle attachment 103 folding right side panel 122 over the top of said infant and left side panel 123 is folded over the top of right side panel 122 and secured with Velcro fastener 124. Bottom flap 120 is then folded over the top of left side panel 123 and secured with Velcro attachment 121. Bottom flap 121 can be opened to provide access to an infant's feet, massage infant's feet or otherwise interact with the infant. As shown in FIG. 3B, the back side of removable swaddle attachment 103 as Velcro attachment 125 which is used to secure the infant wrapped in removable swaddle attachment 103 to Velcro attachment 114, shown in FIG. 2 to secure the placement of the infant and removable swaddle attachment 103 on I See You Baby Blanket™ 101. FIG. 4 represents an embodiment of the present invention that has swaddling attachment 133 permanently attached to front portion 107 of I See You Baby Blanket™ 101.

Figure 5:
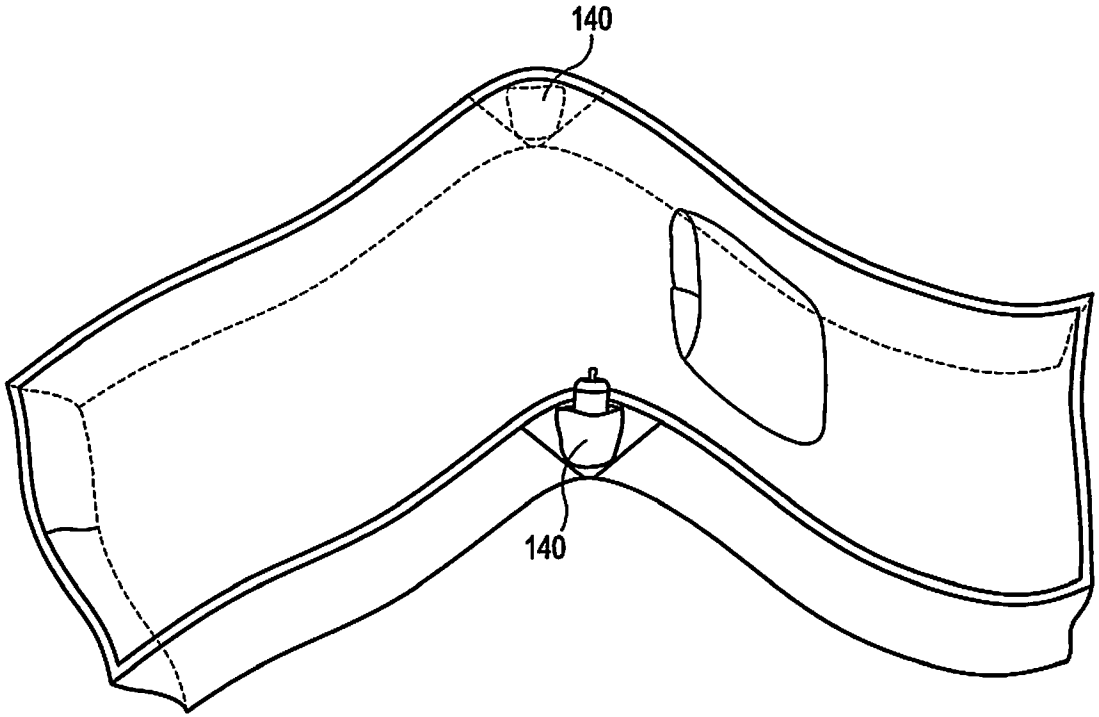
FIG. 5 is a perspective view of an embodiment which includes pockets located at the caregivers knee locations

FIG. 5 depicts an embodiment of I See You Baby Blanket™ 101 with side pockets 140 located at the apex of side panels 105 in the location where a caregiver or parent's knees would be located when using I See You Baby Blanket™ 101. Side pockets 140 can be used to store such items as pacifiers, baby bottles, television remotes or rattles or any other small item to provide it within easy reach of the caregiver. One or more side pockets can be incorporated into any of the embodiments described herein and placed at other locations besides the apex of said side panels including any location deemed to be convenient for the location of any such pocket.

Figure 6:
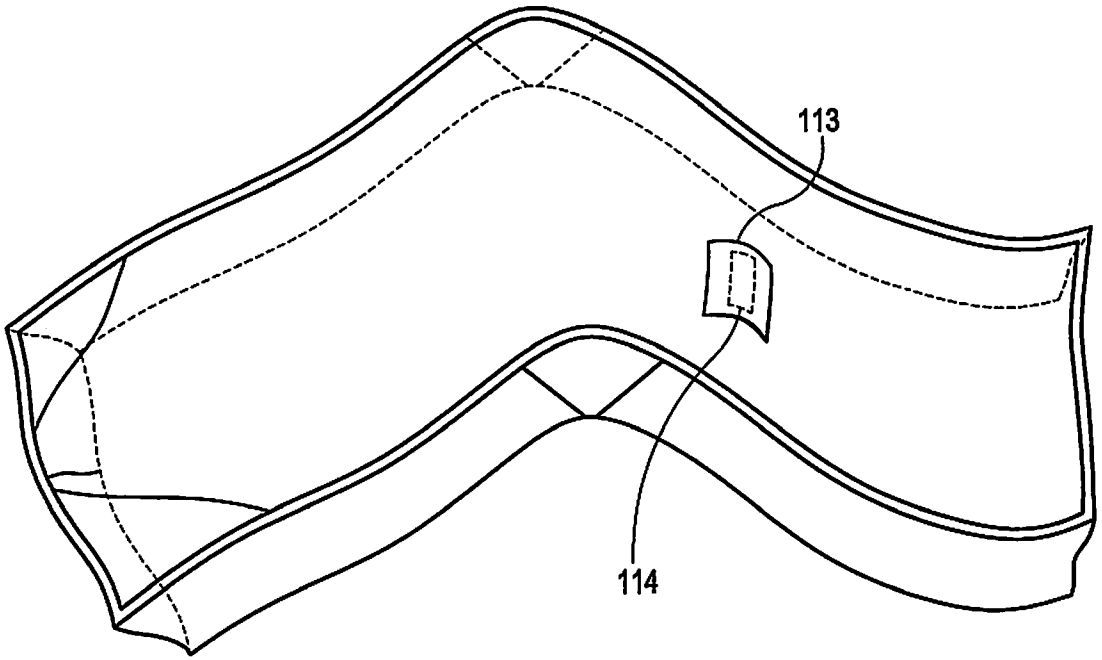
FIG. 6 is a perspective view of the present invention which only covers a caregiver's legs.

FIG. 6 depicts an embodiment of the present invention in which cover 107 covers the upper legs of the caregiver but is not long enough to cover the caregiver's body as shown in FIG. 1. In this FIG. 6 removable swaddle attachment 103 is not in place and Velcro attachment cover 113 is covering Velcro attachment 114.

Figure 7:
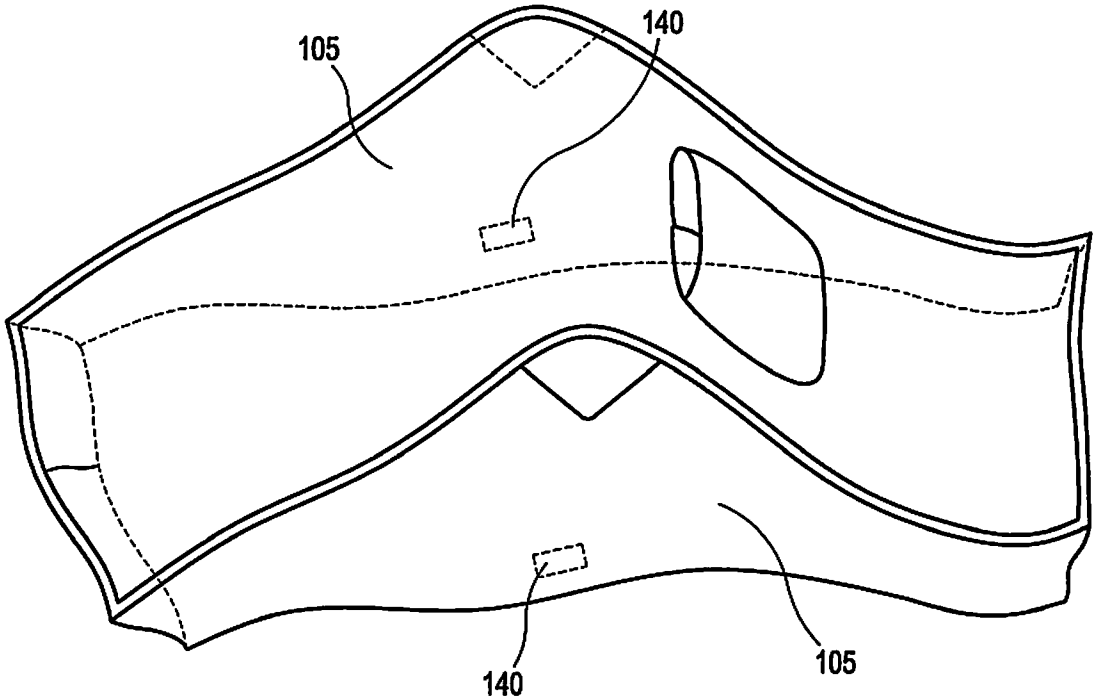
FIG. 7 is an embodiment of the present invention with triangular side panels which can be brought under the knees of the caregiver and secured to each other.

FIG. 7 depicts an embodiment of the present invention in which side panels 105 are triangular in shape and can be brought under the knees of a caregiver and removably connected to each other using attachments 140.

Figure 8:
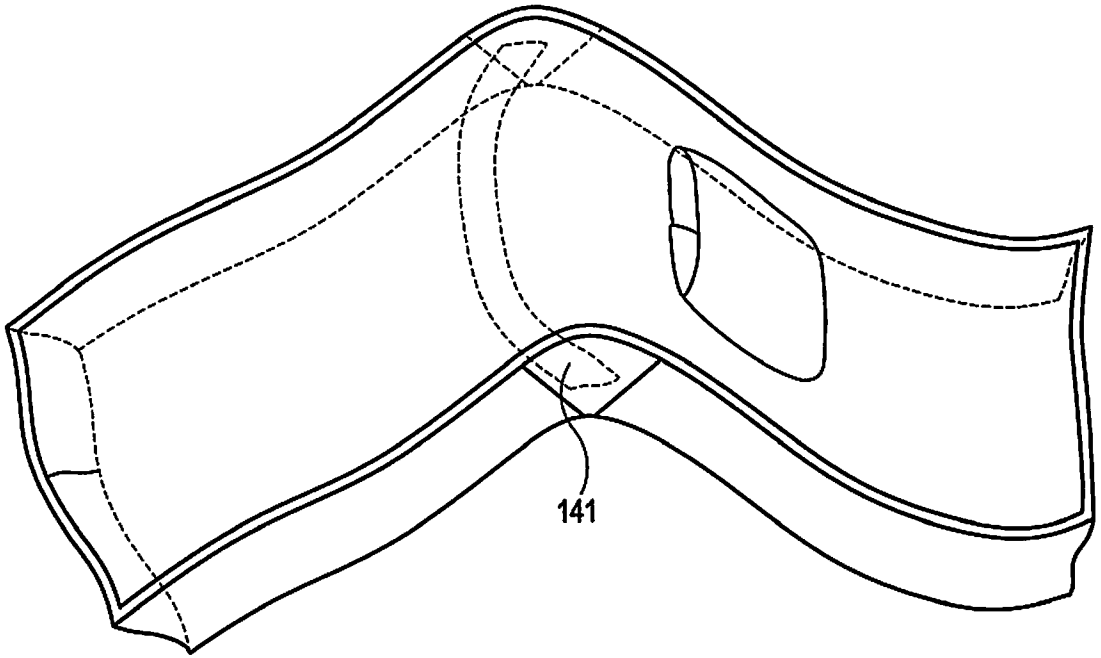
FIG. 8 is a prospective view of an alternate embodiment which includes a strap which passes under the caregiver's knees to secure the side panels.

FIG. 8 depicts an embodiment of the present invention in which strap 141, which passes under a caregivers knees, is connected to side panels 105 either permanently or in a removable manner to provide lateral support to the caregivers legs while holding an infant on I See You Baby Blanket™ 101.

Figure 9:
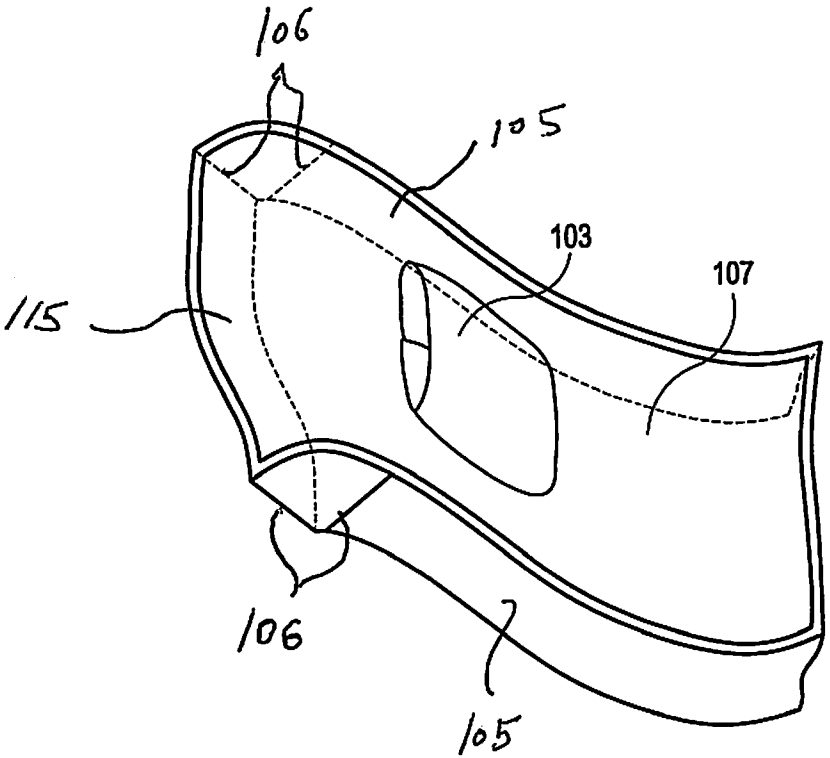
FIG. 9 is an embodiment of the invention which does not include the foot warmer area or the portion of the blanket covering the lower legs of the caregiver.

FIG. 9 depicts an embodiment of the present invention in which cover 107 covers the upper legs of the caregiver and is long enough to cover the caregiver's torso as shown in FIG. 1 with removable swaddle attachment 103 in place. In this embodiment side panels 105 and cover 107 are attached to knee pocket 115 along with reinforced seams 106 to form a space in which a caregiver's knees are placed to provide lateral support to the caregiver's knees and to maintain the position of this embodiment of the present invention when a baby is placed on it. The width of knee pocket 115 must be sufficient to form a pocket which adequately supports the caregiver's knees and may vary to suit individual caregivers and may incorporate the use of strap 141 illustrated in FIG. 8.

Figure 10:
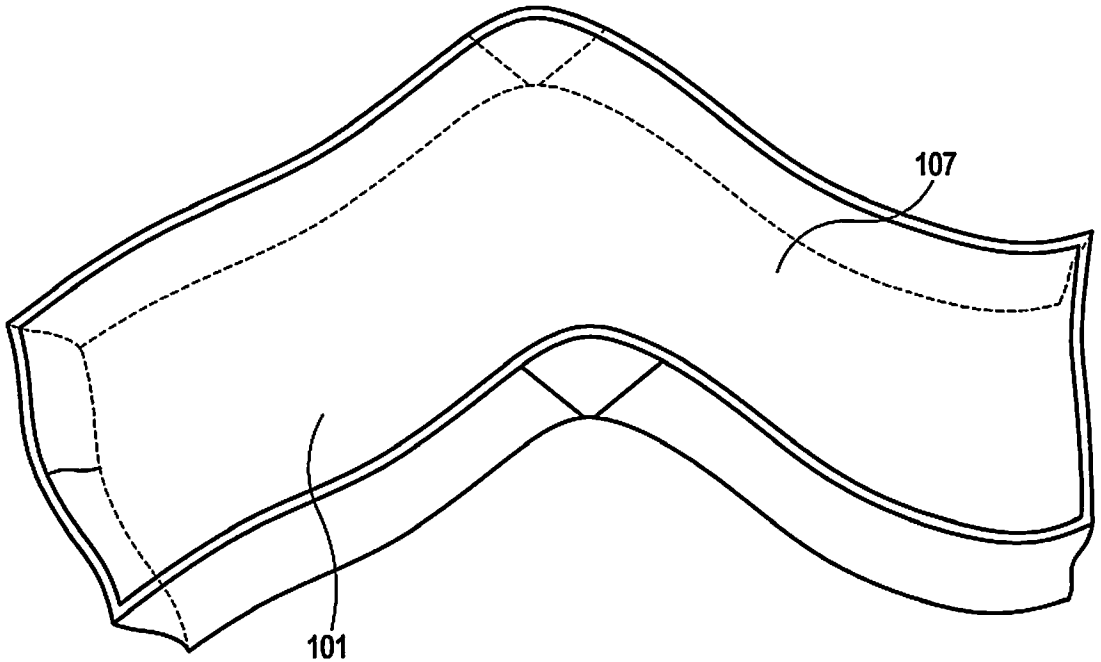
FIG. 10 is an alternate embodiment of the invention in which the infant is cradled between the legs of the caregiver without any swaddle attachment.

FIG. 10 depicts an embodiment of the present invention in which an infant is placed on I See You Baby Blanket™ 101 between the knees of a caregiver directly on cover 107 without the use of any swaddling attachment.

Figure 11:
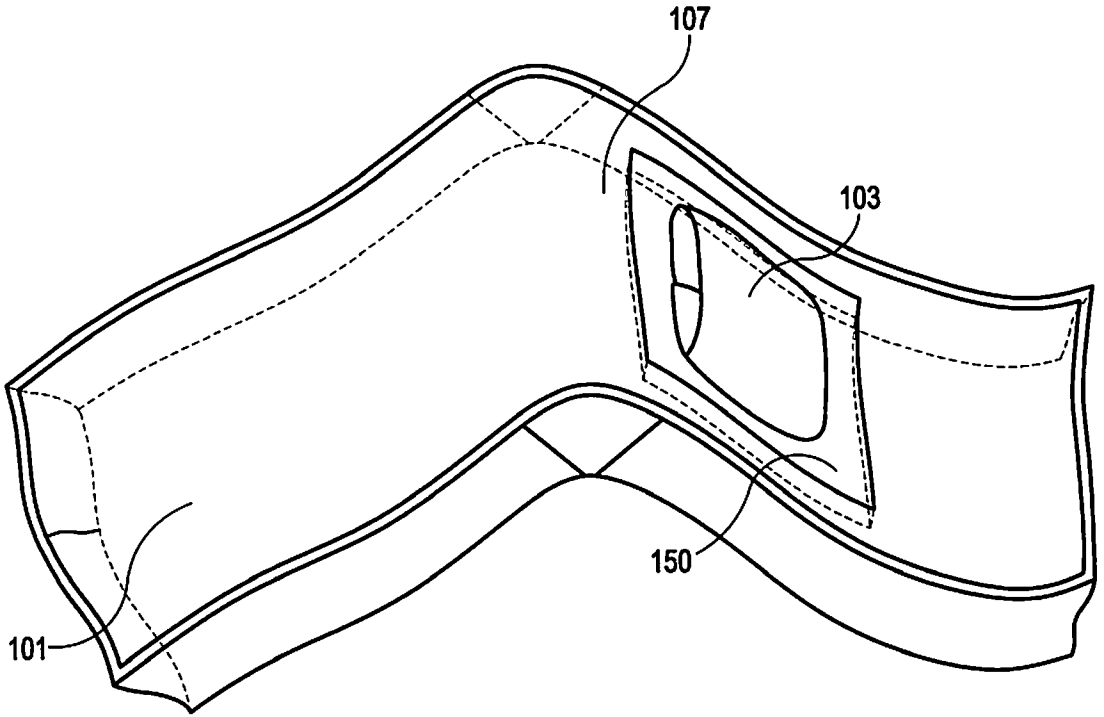
FIG. 11 is an alternate embodiment of the present invention with a padded section between the caregiver's legs.

FIG. 11 depicts an embodiment of the present invention in which padded section 150 is attached to or made part of cover 107 under removable swaddle attachment 103 to provide added cushioning for the infant if, for example, the infant has fallen asleep and the caregiver wishes to place the infant down with minimum disturbance. It is contemplated by the present invention to incorporate padded section 150 into other embodiments thereof and said padded section 150 is further contemplated to be incorporated into cover 107, fixedly or removably attached thereto.

Figure 12:
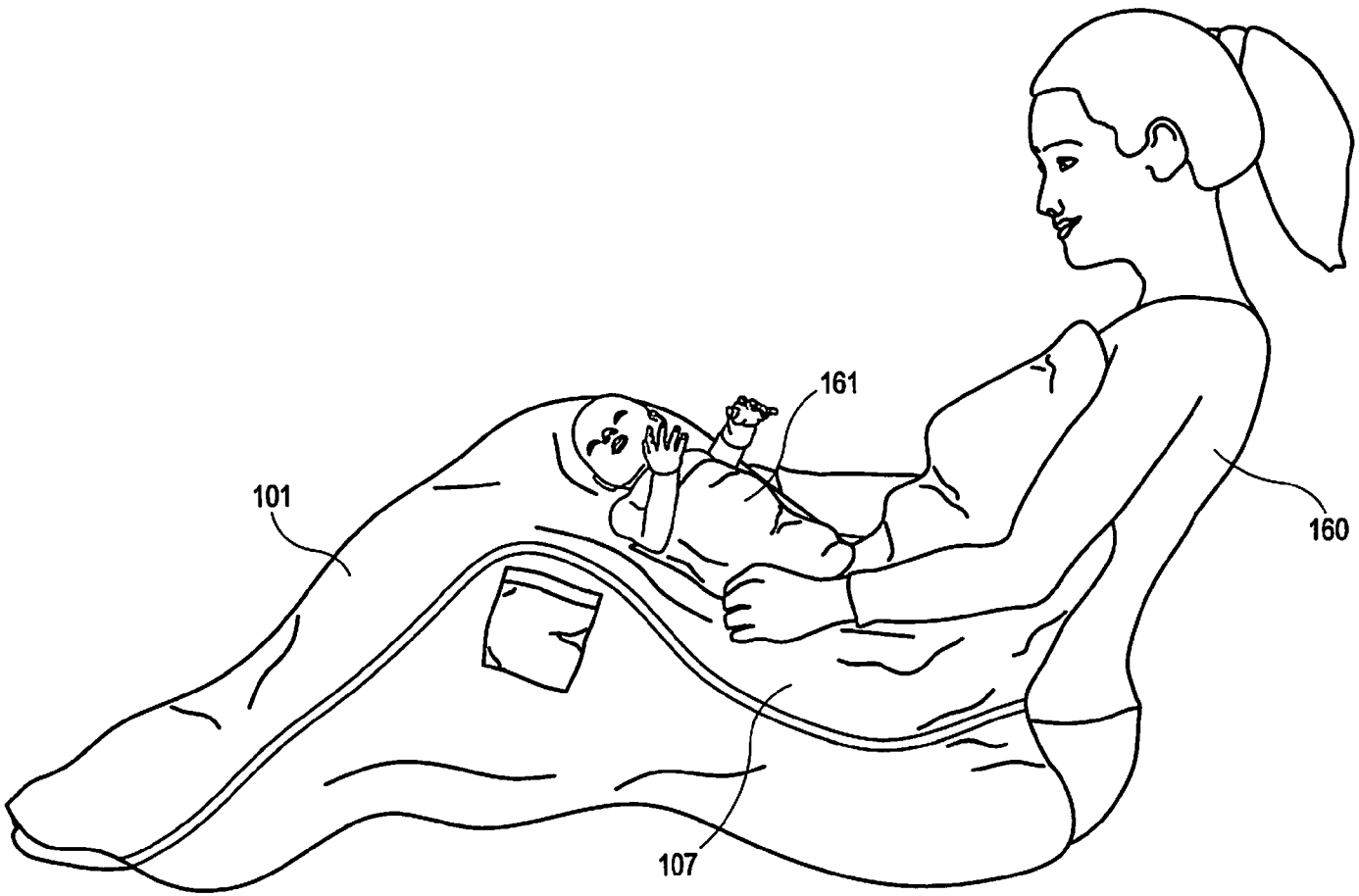
FIG. 12 is an illustration of the caregiver and placement of the infant in the present invention.

FIG. 12 depicts an embodiment of the present invention showing the use of I See You Baby Blanket™ 101 by caregiver 160 to hold infant 161 on upper leg and body cover 107.

Figure 13:
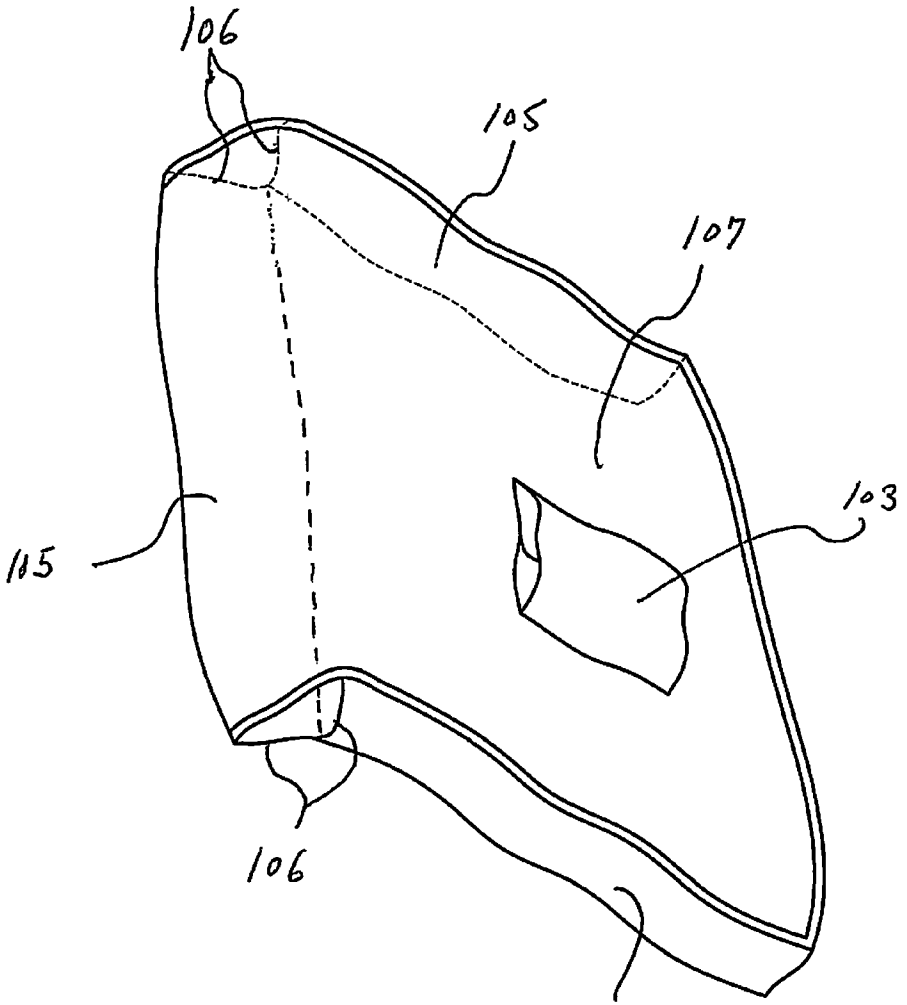
FIG. 13 depicts an embodiment that extends from the knees to the waist of the caregiver.

FIG. 13 depicts an embodiment of the present invention in which I See You Baby Blanket™ 101 does not include lower leg cover 108 and extends only from the caregivers knees and cover 107 covers only the upper legs of the caregiver but is not long enough to cover the caregiver's torso as shown in FIG. 12 with removable swaddle cover 103 in place. In this embodiment side panels 105 and cover 107 are attached to knee pocket 115 along with reinforced seams 106 to form a space in which a caregiver's knees are placed to provide lateral support to the caregiver's knees and to maintain the position of this embodiment of the present invention when a baby is placed on it. The width of knee pocket 115 must be sufficient to form a pocket which adequately supports the caregiver's knees and may vary to suit individual caregivers and may incorporate the use of strap 141 illustrated in FIG. 8.

Figure 14:
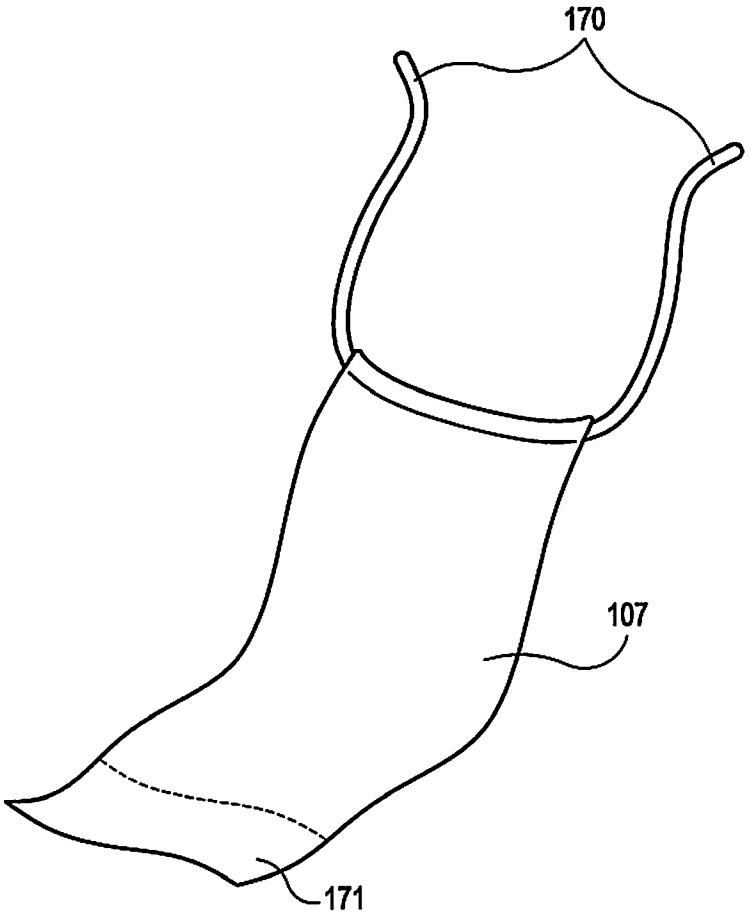
FIG. 14 depicts an embodiment that is worn by the caregiver as an apron

FIG. 14 depicts an embodiment of the present invention similar to that shown in FIG. 13 but capable of being worn by a caregiver like an apron by wrapping apron ties 170 around a caregiver's waist or neck and placing the caregiver's knees in knee pouch 171 to position cover 107 between the upper legs of the caregiver for use. This embodiment as with others can be used with a fixed or removable swaddle cover for the infant or without any swaddle cover.

Figure 15:
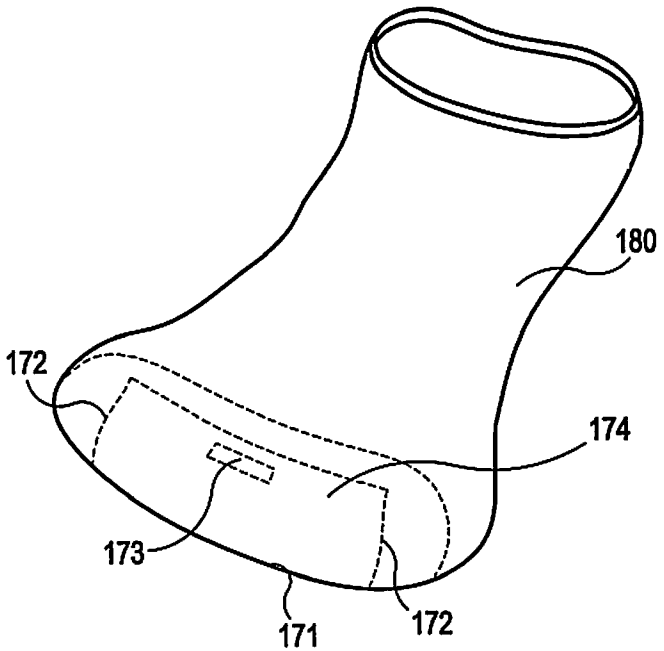
FIG. 15 depicts an embodiment that is worn as a skirt by a parent or caregiver.

FIG. 15 depicts an embodiment of the present invention incorporated into skirt 180 which is worn by a caregiver. To use this embodiment a caregiver would place their knees into knee pouch 171 which is formed by having flap 174 attached to skirt 180 along seams 172. When being worn and not in use flap 174 is removably attached to skirt 180 with fastener 173. This embodiment is used by placing the caregiver's knees in knee pouch 171 to position and hold skirt 180 between the upper legs of the caregiver for use. This embodiment as with others can be used with a fixed or removable swaddle cover for the infant or without any swaddle cover.

The use of other types of wearable coverings that can be adapted to incorporate the features of the present invention are also contemplated. For example a "Snuggie®" type garment could be adapted by providing a means to support an individual's knees as described herein to provide the means to place and support an infant as described herein and further adapted to accommodate a fixed or removable swaddle attachment.

This specification makes reference to Velcro® fastening means, this is the preferred method of providing removable means of attachment where such means are described herein but the use of any other means including but not limited buttons, snaps, zippers are contemplated by this invention.

It is understood that the invention described in the various embodiments set forth herein are merely illustrative of variations of the invention and no limitations are intended and other changes, variations and applications without departure from the accompanying claims will be apparent.

I claim:

1. An improved baby blanket to facilitate the positioning of a caregiver and infant which is comprised of means to provide lateral support to said caregiver's legs when supporting an infant and means to support said infant between the upper legs of said caregiver, wherein the improved baby blanket comprises a generally rectangular shaped fabric blanket which is of sufficient length to cover a caregiver's legs and torso, which is further comprised of foot warmer pockets, side panels with reinforced stitching attaching said side panels to said blanket and a removable swaddle attachment, said swaddle attachment being further comprised of a generally rectangular fabric swaddle blanket comprised of side flaps and a bottom flap which are folded and removably attached to each other by attachment means to wrap an infant in said swaddle blanket which swaddle blanket is removably attached to said baby blanket.

2. An improved baby blanket as described in claim 1, in which said swaddle blanket is fixedly attached to said baby blanket.

3. An improved baby blanket as described in claim 1, which incorporates a padded section located where an infant is positioned on said baby blanket.

4. An improved baby blanket as described in claim 3, in which said padded section is removably attached to said baby blanket.

5. An improved baby blanket as described in claim 1, in which said side panels are rectangular in shape.

6. An improved baby blanket as described in claim 5 which is further comprised of means to attach triangular side panels to each other to provide lateral support to said caregiver's knees.

7. An improved baby blanket to facilitate the positioning of a caregiver and infant which is comprised of means to provide lateral support to said caregiver's legs when supporting an infant and means to support said infant between the upper legs of said caregiver, wherein the improved baby blanket comprises a generally rectangular shaped fabric blanket which is of sufficient length to cover a caregiver's upper legs and torso, which is further comprised of a knee pouch, side panels with reinforced stitching attaching said side panels to said blanket and a removable swaddle attachment, said swaddle attachment being further comprised of a generally rectangular fabric swaddle blanket comprised of side flaps and a bottom flap which are folded and removably attached to each other by attachment means to wrap an infant in said swaddle blanket which swaddle blanket is removably attached to said baby blanket.

8. An improved baby blanket as described in claim 7 in which said swaddle blanket is fixedly attached to said baby blanket.

9. An improved baby blanket as described in claim 7 which incorporates a padded section located where an infant is positioned on said baby blanket.

10. An improved baby blanket as described in claim 9, in which said padded section is removably attached to said baby blanket.

11. An improved baby blanket as described in claim 7 in which said side panels are rectangular in shape.

12. An improved baby blanket as described in claim 11 which is further comprised of means to attach triangular side panels to each other to provide lateral support to said caregiver's knees.

13. An improved device to facilitate the positioning of a caregiver and infant which is comprised of means to provide lateral support to said caregiver's legs when supporting an infant and means to support said infant between the upper legs of said caregiver, wherein the improved device comprises a skirt worn by a caregiver which is further comprised of a knee pouch which provides lateral support to said caregiver's knees when supporting an infant and a removable swaddle attachment, said swaddle attachment being further comprised of a generally rectangular fabric swaddle blanket comprised of side flaps and a bottom flap which are folded and removably attached to each other by attachment means to wrap an infant in said swaddle blanket which swaddle blanket is removably attached to said skirt.

14. An improved baby blanket as described in claim 13, in which the length of said rectangular shaped fabric blanket is of sufficient length to cover the caregiver's legs.

15. An improved device to facilitate the positioning of a caregiver and infant which is comprised of means to provide lateral support to said caregiver's legs when supporting an infant and means to support said infant between the upper legs of said caregiver, wherein the improved device comprises an apron worn by a caregiver which is further comprised of a knee pouch which provides lateral support to said caregiver's knees when supporting an infant and a removable swaddle attachment, said swaddle attachment being further comprised of a generally rectangular fabric swaddle blanket comprised of side flaps and a bottom flap which are folded and removably attached to each other by attachment means to wrap an infant in said swaddle blanket which swaddle blanket is removably attached to said apron.

16. An improved baby blanket as described in claim 15, in which the length of said rectangular shaped fabric blanket is of sufficient length to cover the caregiver's legs.

17. An improved device as described in claim 15 which is further comprised of a strap to provide lateral support for said caregiver's knees.

18. An improved device to facilitate the positioning of a caregiver and infant which is comprised of means to provide lateral support to said caregiver's legs when supporting an infant and means to support said infant between the upper legs of said caregiver, wherein the improved device comprises a wearable covering worn by a caregiver which is further comprised of a knee pouch which provides lateral support to said caregiver's knees when supporting an infant and a removable swaddle attachment, said swaddle attachment being further comprised of a generally rectangular fabric swaddle blanket comprised of side flaps and a bottom flap which are folded and removably attached to each other by attachment means to wrap an infant in said swaddle blanket which swaddle blanket is removably attached to said covering.

19. An improved device as described in claim 18, which is further comprised of a strap to provide lateral support for said caregiver's knees.

* * * * *